US009725815B2

(12) United States Patent
Dudley et al.

(10) Patent No.: US 9,725,815 B2
(45) Date of Patent: Aug. 8, 2017

(54) ELECTROLYSIS APPARATUS

(75) Inventors: Peter G. Dudley, Hickleton (GB); Allen Richard Wright, Gunnerton (GB)

(73) Assignee: METALYSIS LIMITED (GB)

( * ) Notice: Subject to any disclaimer, the term of this patent is extended or adjusted under 35 U.S.C. 154(b) by 168 days.

(21) Appl. No.: 13/988,275

(22) PCT Filed: Nov. 18, 2011

(86) PCT No.: PCT/GB2011/001629

§ 371 (c)(1),
(2), (4) Date: Jul. 24, 2013

(87) PCT Pub. No.: WO2012/066297

PCT Pub. Date: May 24, 2012

(65) Prior Publication Data

US 2013/0299341 A1 Nov. 14, 2013

(30) Foreign Application Priority Data

Nov. 18, 2010 (GB) ..... 1019571.7
Nov. 18, 2010 (GB) ..... 1019613.7

(51) Int. Cl.
*C25C 7/02* (2006.01)
*C25C 7/00* (2006.01)

(52) U.S. Cl.
CPC ..... *C25C 7/025* (2013.01); *C25C 7/00* (2013.01); *C25C 7/002* (2013.01); *C25C 7/005* (2013.01); *C25C 7/02* (2013.01)

(58) Field of Classification Search
CPC C25C 7/00; C25C 7/002; C25C 7/005; C25C 7/02; C25C 7/025
See application file for complete search history.

(56) References Cited

U.S. PATENT DOCUMENTS 2,311,257 A 2/1943 Sawyer et al.
2,897,129 A 7/1959 Dilling
(Continued)

FOREIGN PATENT DOCUMENTS

CA 2138001 6/1995
CL 2976-00 9/2001
(Continued)

OTHER PUBLICATIONS

Ishikawa, T. et al. "Application of a Vertically Stacked Bipolar Electrode Cell to Electrowinning of Liquid Magnesium from Chloride Melts" *Electrochemistry*, 1997, vol. 65, No. 12, pp. 1080-1085.
(Continued)

*Primary Examiner* — Ciel Thomas
(74) *Attorney, Agent, or Firm* — Saliwanchik, Lloyd & Eisenschenk

(57) ABSTRACT

A removable electrode module for engagement with an electrolysis chamber comprises a first electrode, a second electrode, and a suspension structure. The suspension structure comprises a suspension rod coupled to the first electrode. The second electrode is suspended or supported by the suspension structure, which comprises at least one electrically-insulating spacer element for retaining the second electrode in spatial separation from the first electrode.

29 Claims, 9 Drawing Sheets

(56) References Cited

U.S. PATENT DOCUMENTS

| | | | | |
|---|---|---|---|---|
| 3,554,893 | A | 1/1971 | Varda | |
| 3,640,801 | A | 2/1972 | Love | |
| 3,755,099 | A | 8/1973 | Haupin | |
| 3,979,267 | A | 9/1976 | Townsend | |
| 4,154,661 | A | 5/1979 | Hyland et al. | |
| 4,207,153 | A | 6/1980 | Flood | |
| 4,308,114 | A | 12/1981 | Das et al. | |
| 4,400,247 | A | 8/1983 | Ginatta | |
| 4,414,089 | A | 11/1983 | McMonigle et al. | |
| 4,596,637 | A * | 6/1986 | Kozarek et al. | 205/375 |
| 4,728,409 | A * | 3/1988 | Oloman | C25B 9/203 204/256 |
| 4,869,790 | A * | 9/1989 | Charles et al. | 205/367 |
| 5,089,094 | A | 2/1992 | Ogasawara et al. | |
| 5,286,359 | A | 2/1994 | Richards et al. | |
| 5,935,394 | A | 8/1999 | Sivilotti et al. | |
| 5,964,918 | A | 10/1999 | Asada et al. | |
| 6,024,847 | A | 2/2000 | Rosenberg et al. | |
| 6,608,027 | B1 | 8/2003 | Tsantrizos et al. | |
| 2004/0099505 | A1* | 5/2004 | Robinson et al. | 198/485.1 |
| 2004/0159559 | A1 | 8/2004 | Fray et al. | |
| 2004/0173470 | A1 | 9/2004 | Strezov et al. | |
| 2004/0195092 | A1* | 10/2004 | D'Astolfo, Jr. | 204/280 |
| 2006/0049060 | A1 | 3/2006 | Hori | |

FOREIGN PATENT DOCUMENTS

| | | |
|---|---|---|
| CL | 1688-03 | 6/2004 |
| CL | 508-06 | 11/2006 |
| CL | 1138-09 | 8/2009 |
| CL | 2816-11 | 11/2011 |
| CN | 1063909 | 8/1992 |
| CN | 1184725 | 6/1998 |
| CN | 1186528 | 7/1998 |
| CN | 1479810 | 3/2004 |
| CN | 1522315 | 8/2004 |
| CN | 1571866 | 1/2005 |
| CN | 1585828 | 2/2005 |
| CN | 1982506 | 6/2007 |
| CN | 101044268 | 9/2007 |
| CN | 101048518 | 10/2007 |
| CN | 101278063 | 10/2008 |
| CN | 1842617 | 12/2010 |
| DE | 43 44 036 | 6/1995 |
| EP | 0039873 | 11/1981 |
| EP | 0 257 710 | 3/1988 |
| EP | 1 876 248 | 1/2008 |
| EP | 1 942 210 | 7/2008 |
| EP | 1445350 | 10/2009 |
| GB | 833767 | 4/1960 |
| GB | 1 568 499 | 5/1980 |
| IT | 1188878 | 1/1988 |
| JP | S57-23088 | 2/1982 |
| JP | H3-501501 | 4/1991 |
| JP | 3236486 | 10/1991 |
| JP | 5263285 | 10/1993 |
| JP | H11-503794 | 3/1999 |
| JP | 2002-517613 | 6/2002 |
| JP | 2004-502879 | 1/2004 |
| JP | 2004-530798 | 10/2004 |
| JP | 3812951 | 6/2006 |
| JP | 2007-509232 | 4/2007 |
| JP | 2007-529631 | 10/2007 |
| JP | 2008-531854 | 8/2008 |
| JP | 2009197277 | 9/2009 |
| WO | WO 90/01078 | 2/1990 |
| WO | WO 96/33297 | 10/1996 |
| WO | WO 99/64638 | 12/1999 |
| WO | WO 00/03068 | 1/2000 |
| WO | WO 01/96628 | 12/2001 |
| WO | WO 03/002785 | 1/2003 |
| WO | WO 03/031665 | 4/2003 |
| WO | WO 03/053349 | 7/2003 |
| WO | WO 03/066103 | 8/2003 |
| WO | WO 2004/113593 | 12/2004 |
| WO | WO 2005/031041 | 4/2005 |
| WO | WO 2005/037214 | 4/2005 |
| WO | WO 2005/038092 | 4/2005 |
| WO | WO 2005/090640 | 9/2005 |
| WO | WO 2006/092615 | 9/2006 |
| WO | WO 2008/101283 | 8/2008 |
| WO | WO 2010/092358 A1 | 8/2010 |
| WO | WO 2010/130995 A1 | 11/2010 |
| WO | WO 2010/131000 | 11/2010 |
| WO | WO 2010/146369 A1 | 12/2010 |
| WO | WO 2012/066299 | 5/2012 |

OTHER PUBLICATIONS

Kusakabe, K. et al. "Current Paths and Electrolysis Efficiency in Bipolar Packed-Bed Electrodes" *Journal of Chemical Engineering of Japan*, 1982, vol. 15, No. 1, pp. 45-50.

Office Action dated Mar. 31, 2015, issued in Chilean App. No. 2816-2011.

Office Action dated Aug. 6, 2015, issued in Chilean App. No. 1392-2013.

* cited by examiner

ELECTROLYSIS APPARATUS

CROSS-REFERENCE TO RELATED APPLICATION

This application is the National Stage of International Application No. PCT/GB2011/001629, filed Nov. 18, 2011, which is hereby incorporated by reference herein in its entirety, including any figures, tables, nucleic acid sequences, amino acid sequences, or drawings.

The invention relates to electrolysis apparatus, in particular to removable electrode modules for use in electrolysis reactions and systems for electrolysis comprising removable electrode modules.

BACKGROUND

The present invention concerns apparatus for the reduction of a solid feedstock comprising a metal compounds or compounds, such as a metal oxide, to form reduced products. As is known from the prior art, such processes may be used, for example, to reduce metal compounds or semi-metal compounds to metals, semi-metals, or partially-reduced compounds, or to reduce mixtures of metal compounds to form alloys. In order to avoid repetition, the term metal will be used in this document to encompass all such products, such as metals, semi-metals, alloys, intermetallics, and partially-reduced products.

In recent years there has been great interest in the direct production of metal by reduction of a solid feedstock, for example, a solid metal-oxide feedstock. One such direct reduction process is the Cambridge FFC electro-decomposition process (as described in WO 99/64638). In the FFC process a solid compound, for example a solid metal oxide, is arranged in contact with a cathode in an electrolysis cell comprising a fused salt. A potential is applied between the cathode and an anode of the cell such that the compound is reduced. In the FFC process, the potential that produces the solid compound is lower than a deposition potential for a cation from the fused salt. For example, if the fused salt is calcium chloride, then the cathode potential at which the solid compound is reduced is lower than a deposition potential for depositing metallic calcium from the salt.

Other reduction processes for reducing feedstock in the form of a cathodically-connected solid metal compound have been proposed, such as the polar process described in WO 03/076690 and the process described in WO 03/048399.

Conventional implementations of the FFC process and other electrolytic reduction processes typically involve the production of a feedstock in the form of a preform or precursor, fabricated from a powder of the solid compound to be reduced. This preform is then painstakingly coupled to a cathode to enable the reduction to take place. Once a number of preforms have been coupled to the cathode, then the cathode can be lowered into the molten salt and the preforms can be reduced. It can be highly labour intensive to produce the preforms and then attach them to the cathode. Although this methodology works well on a laboratory scale, it does not lend itself to the mass productions of metal on an industrial scale.

It is an aim of the invention to provide an electrolysis apparatus, components of an electrolysis apparatus, and a method of using an electrolysis apparatus more suitable for the reduction of a solid feedstock on an industrial scale.

SUMMARY OF THE INVENTION

The invention provides, in its various aspects, a removable electrode module for engagement with an electrolysis chamber of an electrolysis apparatus, an electrolysis system comprising a removable electrode module, an electrolysis method and an electrode for an electrolysis module as defined in the appended independent claims, to which reference should now be made. Preferred or advantageous features of the invention are set out in various dependent sub-claims.

Thus, in a first aspect the invention may provide a removable electrode module for engagement with an electrolysis chamber. The removable electrode module, which may alternatively be termed a removable electrode assembly or a removable electrode apparatus, comprises a first electrode, a second electrode, and a suspension structure comprising a suspension rod. The suspension rod is coupled, preferably at one end of the rod, to the first electrode. The second electrode is suspended by, or supported by, the suspension structure and the suspension structure further comprises at least one electrically-insulating spacer element for retaining the second electrode in spatial separation from the first electrode.

Preferably the first electrode is a terminal cathode and the second electrode is a terminal anode, the terminal cathode and the terminal anode being couplable to a power supply to enable a potential to be applied between the terminal cathode and the terminal anode.

The electrode module may advantageously be used for the reduction of a solid feedstock, preferably the reduction of a metal compound such as a metal oxide. Preferably the solid feedstock is retainable in contact with a first surface of the first electrode such that the solid feedstock can be reduced by electrolysis.

It may be particularly advantageous that the electrode module further comprises a cover for closing and opening of the electrolysis chamber when the module is in engagement with the electrolysis chamber. The cover preferably interacts with a surface or rim surrounding the opening of the electrolysis chamber to seal the opening of the electrolysis chamber and/or to support at least part of the weight of the electrode module. The temperatures within the electrolysis chamber may reach as high as 1200° C. during an electrolysis reaction in a molten salt. Furthermore, during typical electrolysis reactions various gases are evolved. Thus, it may be advantageous if the cover can seal the chamber, or act as a seal to an opening of the electrolysis chamber, during an electrolysis reaction.

In a second aspect, the invention may provide a removable electrode module for engagement with an electrolysis chamber comprising an anode and a cathode for supporting a portion of solid feedstock for reduction by electrolysis in a molten salt electrolyte, the feedstock being retained in contact with the cathode.

The electrode module may further comprise a cover for closing and opening of the electrolysis chamber as described above in relation to the first aspect of the invention.

In a third aspect, the invention may provide a removable electrode module for engagement with an electrolysis chamber, the removable electrode module comprising a first electrode and a cover. When the removable electrode is engaged with the electrolysis apparatus the first electrode is located within the electrolysis chamber so that it may be used for electrolysis, and the cover spans an opening of the electrolysis chamber.

Preferably the cover seals the opening of the electrolysis chamber when the module is engaged with the electrolysis chamber. As described above, the temperature within the electrolysis chamber may be high, and gases may be evolved. Therefore it may be advantageous for a cover of the electrode module to seal the opening of the electrolysis chamber.

Advantageously, an embodiment of the electrode module may comprise a second electrode, preferably in which the first electrode is a cathode and the second electrode is an anode.

Advantageously, the electrode or electrodes and the cover may be supported by a suspension structure comprising a suspension rod and an electrically-insulating spacer element.

In a fourth aspect, the invention may provide a removable electrode module for engagement with an electrolysis chamber, the removable electrode module comprising a lifting element to enable the module to be lifted, a first electrode coupled to a lower end of a suspension rod, and a resilient means disposed between the lifting element and an upper end of the suspension rod.

The module may comprise more than one suspension rod and may have a resilient means disposed between an upper end of each suspension rod and the lifting element. Preferably the resilient means comprises a spring, for example a helical spring or a Belleville spring.

The following optional features may be provided in an embodiment of a removable electrode module according to any of the four aspects described above.

A module may comprise an anode formed from or comprising carbon, for example an anode comprising graphite. An anode may be made from alternative materials such as an inert anode material.

A module may comprise a suspension rod and the rod may be formed from a metallic material that retains strength at high temperatures. For example, a suspension rod may be formed from a stainless steel or a high strength low alloy steel or from a nickel alloy. Various suitable high strength metals are known to the person skilled in the art.

A module may comprise electrically-insulating spacer elements. Such spacer elements may be formed from any suitable material such as a ceramic. Suitable ceramics for use as an electrically-insulating spacer element may include alumina ($Al_2O_3$), yttria ($Y_2O_3$), silicon nitride ($Si_3N_4$), and boron nitride (BN).

A module may advantageously include one or more bipolar elements to increase the cathodic surface area available for electrolysis. A module comprising bipolar electrodes may be described as comprising a bipolar stack. A bipolar electrode is an electrode that is interposed between a terminal anode and a terminal cathode such that it develops an anodic surface and a cathodic surface when a potential is applied between the terminal anode and the terminal cathode. It is advantageous for a module comprising a bipolar stack to be arranged with a terminal anode above the bipolar electrodes and a terminal cathode below the bipolar electrodes. This results in the upper surfaces of the bipolar electrodes becoming cathodic, which may facilitate retention of a solid feedstock on the upper surface of an electrode.

It may be advantageous that a removable electrode module according to an embodiment of the invention is used to reduce a solid feedstock by an electrolytic reduction process such as electro-decomposition. For example, the reduction may be carried out by the FFC Cambridge process of electro-decomposition as described in WO 99/64638, or by the Polar process described in WO 03076690 or the Reactive Metal variant described in WO 03/048399.

The solid feedstock is preferably made up from a plurality of constituent units. It is preferred that the individual constituent units of the feedstock are in the form of granules or particles, or in the form of preforms made by a powder processing method. Known powder processing methods suitable for making such a preform include, but are not limited to, pressing, slip-casting, and extrusion.

Preforms made by powder processing may be in the form of prills. Powder processing methods may include any of the known conventional manufacturing techniques such as extrusion, spray drying or pin mixers etc. Once formed the constituent units of feedstock may be sintered to improve/increase their mechanical strength sufficiently to enable the necessary mechanical handling.

It may be advantageous that the feedstock is able to be loosely poured onto the surfaces of electrodes in the module. At present, many electro-reduction methods for reducing a solid feedstock involve the step of coupling individual units or parts of the solid feedstock to the cathode. Advantageously, the invention may allow a large amount of feedstock to be introduced or arranged on the upper surfaces of electrodes simply by pouring it on.

Feedstock may be distributed onto the upper surface of individual electrodes within an electrode module. In a preferred embodiment feedstock may be applied to individual electrodes by removing a portion of that element from the module to allow access for loading. Access may be facilitated, for example, by lifting or sliding a portion of an electrode out of the module, pouring on feedstock, or arranging feedstock in any other way, and placing or sliding the portion of the electrode back into the module.

A fifth aspect of the invention may provide a method of reducing a solid feedstock comprising the steps of; loading the solid feedstock onto a first surface of a first electrode of a removable electrode module, the electrode module comprising the first electrode and a second electrode spaced from the first electrode, the first surface of the electrode capable of becoming, in use, cathodic, engaging the removable electrode module with an electrolysis chamber such that the electrode surface and the feedstock are in contact with a molten salt contained within the electrolysis chamber, and; applying a voltage to the electrode module such that a cathodic potential at the first surface of the first electrode causes reduction of the feedstock.

The electrode module may be any electrode module described herein.

The term molten salt (which may alternatively be termed fused salt, molten salt electrolyte, or electrolyte) may refer to systems comprising a single salt or a mixture of salts. Molten salts within the meaning used by this application may also comprise non-salt components such as oxides. Preferred molten salts include metal halide salts or mixtures of metal halide salts. A particularly preferred salt may comprise calcium chloride. Preferably the salt may comprise a metal halide and a metal oxide, such as calcium chloride with dissolved calcium oxide. When using more than one salt it may be advantageous to use the eutectic or near eutectic composition of the relevant mixture, for example to lower the melting point of the salt used.

The various aspects and embodiments of the invention as described herein may lend themselves particularly well to the reduction of large batches of solid feedstock, on a commercial scale. In particular, embodiments of a removable electrode module comprising a vertical arrangement of bipolar electrodes may allow a large number of bipolar elements to be arranged within a small plant footprint, effectively increasing the amount of reduced product that can be obtained per unit area of a processing plant.

The various aspects and embodiments of the invention described herein are particularly suitable for the production of metal by the reduction of a solid feedstock comprising a solid metal oxide. Pure metals may be formed by reducing a pure metal oxide and alloys and intermetallics may be formed by reducing feedstocks comprising mixed metal oxides or mixtures of pure metal oxides.

Some reduction processes may only operate when the molten salt or electrolyte used in the process comprises a metallic species (a reactive metal) that forms a more stable oxide than the metallic oxide or compound being reduced. Such information is readily available in the form of thermodynamic data, specifically Gibbs free energy data, and may be conveniently determined from a standard Ellingham diagram or predominance diagram or Gibbs free energy diagram. Thermodynamic data on oxide stability and Ellingham diagrams are available to, and understood by, electrochemists and extractive metallurgists (the skilled person in this case would be well aware of such data and information).

Thus, a preferred electrolyte for a reduction process may comprise a calcium salt. Calcium forms a more stable oxide than most other metals and may therefore act to facilitate reduction of any metal oxide that is less stable than calcium oxide. In other cases, salts containing other reactive metals may be used. For example, a reduction process according to any aspect of the invention described herein may be performed using a salt comprising lithium, sodium, potassium, rubidium, caesium, magnesium, calcium, strontium, barium, or yttrium. Chlorides or other salts may be used, including mixture of chlorides or other salts.

By selecting an appropriate electrolyte, almost any metal oxide may be capable of reduction using the methods and apparatuses described herein. In particular, oxides of beryllium, boron, magnesium, aluminium, silicon, scandium, titanium, vanadium, chromium, manganese, iron, cobalt, nickel, copper, zinc, germanium, yttrium, zirconium, niobium, molybdenum, hafnium, tantalum, tungsten, and the lanthanides including lanthanum, cerium, praseodymium, neodymium, samarium, and the actinides including actinium, thorium, protactinium, uranium, neptunium and plutonium may be reduced, preferably using a molten salt comprising calcium chloride.

The skilled person would be capable of selecting an appropriate electrolyte in which to reduce a particular metal oxide, and in the majority of cases an electrolyte comprising calcium chloride will be suitable.

SPECIFIC EMBODIMENTS OF THE INVENTION

Specific embodiments of the invention will now be described with reference to the figures in which.

A removable electrode module according to a first embodiment of the invention will now be described with reference to FIGS. 1 to 4. The electrode module 10 comprises a terminal anode 20, a terminal cathode 30, and seven bipolar electrodes 40, 41, 42, 43, 44, 45, 46 distributed in spatial separation from each other above the terminal cathode 30 and below the terminal anode 20. The terminal cathode 30, the terminal anode 20, and each of the intermediate bipolar electrodes 40, 41, 42, 43, 44, 45, 46, are substantially circular in shape and have a diameter of about 550 mm.

The diameter of the cathode and anodes may of course be different to this. For example, the diameter may range from about 100 mm to 5000 mm or more.

Figure 9:
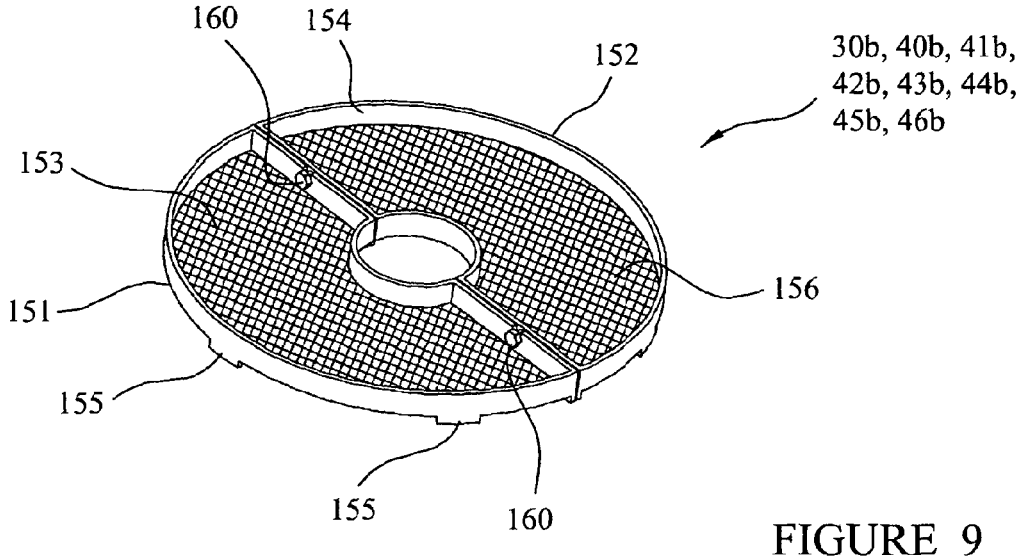
FIG. 9 is a perspective-view of a removable cathode-tray structure suitable for use as a cathode-tray in the removable electrode module of FIG. 1.
Figure 10:
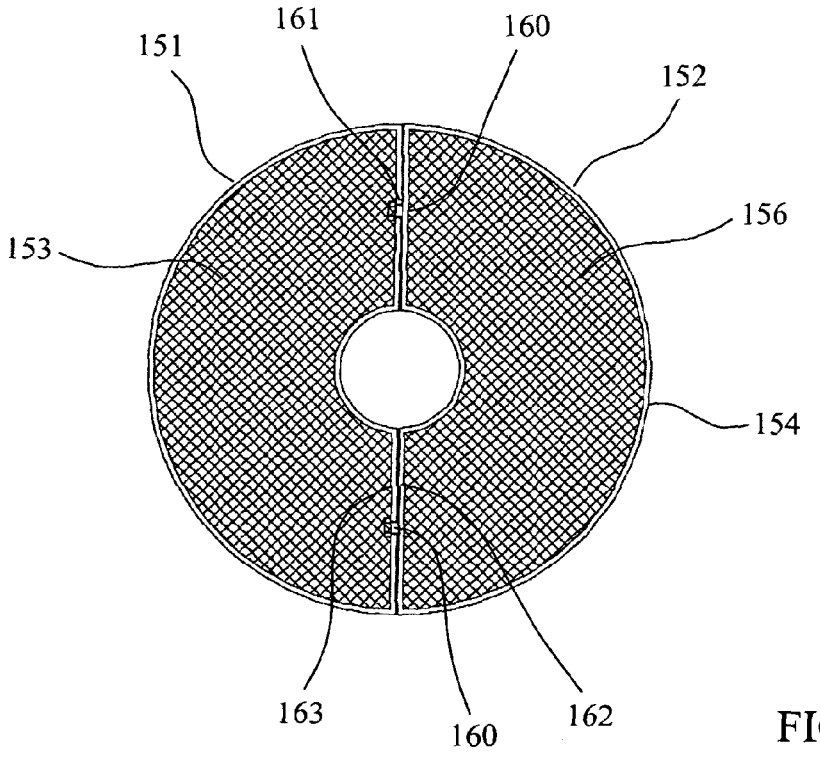
FIG. 10 is a plan-view of the cathode-tray structure of FIG. 9.
Figure 11:
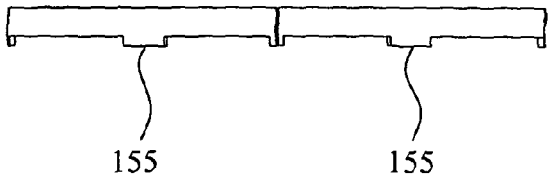
FIG. 11 is a side-view of the cathode-tray structure of FIG. 9.

The terminal cathode 30 has a composite structure consisting of a lower portion and an upper portion. The lower portion is a substantially cathode base element 30*a* formed from a disc of grade 310 stainless steel having a diameter of 550 mm and a thickness of 60 mm. The upper portion is provided by a removable tray-assembly 30*b* seated on an upper surface of the base element 30*a*. The removable tray-assembly 30*b* is illustrated in FIGS. 9, 10 and 11 and will be described in more detail below. A central hole having a diameter of about 130 mm is defined through the central portion of the assembled tray-assembly 30*b*.

Each of the seven bipolar electrodes 40, 41, 42, 43, 44, 45, 46, has a composite structure comprising a lower portion 40*a*, 41*a*, 42*a*, 43*a*, 44*a*, 45*a*, 46*a* and an upper, or tray-assembly, portion 40*b*, 41*b*, 42*b*, 43*b*, 44*b*, 45*b*, 46*b*. The upper, tray-assembly, portions of each of the bipolar electrodes are identical to the upper, tray-assembly, portion 30*b* of the terminal cathode 30.

The lower portions 40*a*, 41*a*, 42*a*, 43*a*, 44*a*, 45*a*, 46*a* of each of the bipolar electrodes are formed from discs of carbon, for example graphite, having a diameter of 550 mm and a thickness of 60 mm. A hole having a diameter of about 130 mm is defined through the central portion of each of the bipolar electrodes 40, 41, 42, 43, 44, 45, 46.

On a lower surface of each bipolar electrode a plurality of channels 50 of approximately 10 mm in width are defined in order to aid the channelling of gas evolved on the lower surface of each bipolar electrode to the outer circumference of each bipolar electrode.

A first bipolar electrode 40 is supported directly above the terminal cathode 30 by a first electrically-insulating spacer element 60. The first electrically-insulating spacer element 60 is a tubular spacer formed from alumina. The first electrically-insulating spacer element may alternatively be formed from other electrically-insulating ceramic materials such as silicon nitride, yttria, or boron nitride. The first spacer element 60 is 90 mm in height. Thus, the separation between an upper surface of the cathode base plate 30*a* and a lower surface of the lower portion of the first bipolar electrode 40*a*, is 90 mm.

In some embodiments the first electrically-insulating spacer element 60 is seated directly on the cathode base element 30*a*. In other embodiments, a ceramic insert 70, formed from a ceramic material that will not reduce under the cell operating conditions, is disposed between the terminal cathode base element 30*a* and the first electrically-insulating spacer element 60.

A lower surface of the lower portion 40*a* of the first bipolar electrode 40 is seated on the first electrically-insulating spacer element 60 such that the first bipolar electrode 40 is supported, through the first electrically-insulating spacer element 60, by the terminal cathode base element 30*a*.

The second bipolar electrode 41 is supported directly above the first bipolar electrode 40 by means of a second electrically-insulating spacer element 61. The second electrically-insulating spacer element 61 is a tubular alumina element that is substantially identical to the first electrically-insulating spacer element 60. The second electrically-insulating spacer element is seated on an upper surface of the lower portion 40*a* of the first bipolar electrode 40. A lower surface of the lower portion 41*a* of the second bipolar electrode is, in turn, seated on the second electrically-insulating spacer element such that the second bipolar electrode 41 is supported, by means of the second electrically-insulating spacer element 61, by the first bipolar electrode.

This support structure is repeated for each of the bipolar electrodes. Thus, a third bipolar electrode 42 is supported by the second bipolar electrode 41 by means of a third electrically-insulating spacer element 62. A fourth bipolar electrode 43 is supported by the third bipolar electrode 42 by means of a fourth electrically-insulating spacer element 63. A fifth bipolar electrode 44 is supported by the fourth bipolar electrode 43 by means of a fifth electrically-insulating spacer element 64. A sixth bipolar electrode 45 is supported by the fifth bipolar electrode 44 by means of a sixth electrically-insulating spacer element 65. A seventh bipolar electrode 46 is supported by the sixth bipolar electrode 45 by means of seventh electrically-insulting spacer element 66.

The terminal anode 20 is formed from a disc of graphite having a diameter of 550 mm and a thickness of 60 mm. Channels are defined on the lower surface of the anode the same way as defined above in relation to the bipolar electrodes. One purpose of these channels is to assist the removal of gas evolved at the lower surface of the terminal anode 20. A hole is defined through a central portion of the terminal anode 20 having a diameter of about 130 mm. The terminal anode is supported directly above the seventh bipolar electrode 46 by means of an eighth electrically-insulating spacer element 67.

The first to eighth spacer elements all have a height of 90 mm.

The removable electrode module 10 further comprises an insulating ceramic cover 100 disposed directly above the terminal anode 20. The cover 100 is formed from alumina, although any thermally-insulating ceramic material could be used, and is designed to cover an electrolysis chamber of an electrolysis apparatus during an electrolysis reaction. The cover 100 is supported by an upper surface of the terminal anode 20 by means of a ninth electrically-insulating supporting element 68. The ninth electrically-insulating support 68 is similar to the electrically-insulating support elements previously described, but has greater length.

A central hole is defined through the cover 100. Thus, a hole or cavity is defined that extends downwardly through the removable electrode module from an upper surface 101 of the cover 100 through the tubular electrically-insulating spacer 68, through the centre of the anode, and through each of the bipolar electrodes and their associated spacer elements. A suspension rod 110 extends through this hole or cavity and is coupled to the cathode base element 30*a* of the terminal cathode 30 by means of a thread that engages with a threaded hole defined in the cathode base element 30*a*. The suspension rod 110 does not contact any other electrode or spacing element. At the point that the suspension rod 110 passes through the central hole defined through the cover 100, a seal is formed by means of a graphite gland packing, for example braided graphite rope or other similar gland packing materials 120.

At its upper portion, the suspension rod 110 is coupled to a j-slot type connector 130. A j-slot connector is a bayonet connector that is well known for coupling sections of pipe in the oil industry. The coupling between the suspension rod and the j-slot connector is achieved by means of washers and nuts 111.

The suspension rod 110 may be used to lift the entire removable electrode module 10, for example when raising or lowering the electrode module. In use, the suspension rod may need to function at high temperatures. Therefore, the rod 110 and associated nuts and washers 111 that couple the rod 110 to the j-slot connector 130 are formed from a high nickel alloy suitable for operation at high temperatures.

The anode 20 is coupled to two graphite risers 21, 22 to enable an electrical connection to be made between a power supply (not shown) and the terminal anode 20. The graphite risers 21, 22 are coupled to the terminal anode 20 by means of graphite studs 23, 24. The graphite risers 21, 22 extend vertically above the terminal anode 20 through holes defined in the cover 100, such that an electrical connection can be made with an uppermost portion of the risers when the removable electrode module is located in engagement with an electrolysis chamber of an electrolysis apparatus. A gap between the risers 21, 22 and the associated holes defined through the cover 100 for the risers to pass through is sealed by means of braided graphite rope or other similar gland packing materials 25.

The removable electrode module 10 is designed to have three loading or support conditions.

In the first of these three conditions, the removable electrode module is seated on a lower surface of the cathode base element 30*a*. In this condition the weight of all of the bipolar elements, the anode, and the cover are transferred through the cathode base element 30*a* and the suspension rod 110 is not in tension.

In a second loading condition, the j-slot connector 130 is coupled to a lifting mechanism, and the entire weight of the module is supported through the suspension rod 110, which is coupled to the cathode base element 30*a*.

In a third loading condition, the removable electrode module 10 may be supported at multiple points on a lower surface 102 of the cover 100. In this condition the weight of the module is supported by the cover 100 and transferred through the suspension rod 110, which is coupled to the cathode base element 30*a*.

Thus, the module may be free-standing on its cathode base element 30*a*, it may be suspended by the j-slot coupling 130 at an upper end of the suspension rod 110, or it may be suspended by the underside 102 of the cover 100.

The suspension rod 110 is coated or clad with an electrically-insulating material 115 throughout its length from the point of coupling to the cathode base element 30*a* to the point of sealing with the braided graphite rope 120 as the suspension rod 110 passes through the cover 100. This electrically-insulating material is an alumina coating 115, but may be any high temperature electrically-insulating material. For example, the coating 115 may be boron nitride. The coating may be applied by any known method, for example by dip coating or by spray coating.

The removable tray-assembly that forms part of the terminal cathode 30 and each of the seven bipolar electrodes 40, 41, 42, 43, 44, 45, 46 is illustrated in FIGS. 9, 10 and 11. The tray assembly 30*b*, 40*b*, 41*b*, 42*b*, 43*b*, 44*b*, 45*b*, 46*b*, is formed of two couplable portions 151, 152. When coupled together, the entire tray-assembly is substantially circular and has a diameter of about 542 mm at room temperature. The tray-assembly is metallic and so the diameter may increase to about 550 mm at the working temperature of the removable electrode module (usually between about 500° C. and 1200° C. when used in an electrolysis reaction in a molten salt) due to thermal expansion.

A base 153, 156 of each of the tray-assembly portions 151, 152 is formed from a mesh suitable for supporting a solid feedstock. Around the circumference of the assembled tray-assembly a circumferential lip is raised extending about 30 mm above the level of the mesh 153, 156. A plurality of downwardly extending feet 155 extend downwards from the circumferential lip 154 by a distance of about 10 mm below the level of the mesh 153, 156.

The entire tray-assembly may be seated on an upper surface of an associated electrode portion to form an electrode of the electrode module. For example, a tray assembly 30*b* may be seated on an upper surface of the terminal cathode base plate 30*a* to form a terminal cathode 30, or a tray assembly 40*b*, 41*b*, 42*b*, 43*b*, 44*b*, 45*b*, 46*b* may be seated on an upper surface of the lower portion of a bipolar electrode 40*a*, 41*a*, 42*a*, 43*a*, 44*a*, 45*a*, or 46*a* to form a bipolar electrode. Electrical contact is made between the tray-assembly and its associated electrode portion through the downwardly extending feet 155. The downwardly extending feet hold the mesh 153, 156 in spatial separation from an upper surface of the cathode or bipolar electrode on which the tray-assembly is seated.

When a removable electrode module comprising the removable tray-assemblies 30*b*, 40*b*, 41*b*, 42*b*, 43*b*, 44*b*, 45*b*, 46*b* is located in an electrolysis chamber containing a molten salt, molten salt is able to flow into a gap created between the upper surface of an electrode portion on which the tray assembly is seated and the mesh base 153, 156. The molten salt is therefore able to flow upwardly through the mesh base 153, 156 of the tray-assembly and, therefore, over any solid feedstock supported on the base 153, 156.

The tray-assembly is formed having a central hole for surrounding an electrically-insulating spacer element, for example the electrically-insulating spacer element 60 that supports the first bipolar electrode 40.

The tray-assembly is formed in two couplable portions, i.e. the first portion 151 and the second portion 152, each portion being substantially semicircular. The two portions 151, 152 are coupleable by means of a stud and slot arrangement. Studs 160 extend from a mating surface or mating edge 162 of the second portion and slots 161 for receiving the studs 160 are defined in a corresponding mating surface 163 of the first portion 151.

In use, each half or each portion 151, 152 of the tray-assembly may be separately removed from the removable electrode module 10 in order to load feedstock or unload reduced product.

The removable tray-assemblies form the uppermost portion of the terminal cathode and each of the bipolar electrodes. These portions of the respective electrodes become cathodic when the removable electrode module is used for electrolysis.

The removable tray-assemblies 30*b*, 40*b*, 41*b*, 42*b*, 43*b*, 44*b*, 45*b*, 46*b* are manufactured from 310-grade stainless steel. The removable tray-assemblies may be made from many other materials, and the choice of material may depend on the nature of the feedstock to be reduced. For example, it may be desirable to use a tray-assembly formed from a metal that will not contaminate the reduced product. For example, it may be desirable to form the cathode tray assembly from tantalum, or tantalum coated metal, where the removable electrode module is to be used for the reduction of a tantalum oxide to tantalum metal.

A removable electrode module according to the first specific embodiment described above may be of particular advantage when used for the reduction of a solid feedstock in a molten salt electrolyte. The removable tray-assemblies allow a solid feedstock to be conveniently loaded onto each separate removable tray-assembly portion 151, 152 and loaded into the removable electrode module by seating the loaded tray-assembly portions in an appropriate position in the electrode module.

At room temperature, the removable electrode module 10 has a total height from the lower surface of the cathode base plate 30*a* to the lower surface of the cover 100 of 1645 mm. The height from the lower surface of the cathode base plate 30*a* to the top of the j-slot connector 130 is 2097 mm. As stated above, the diameter of the electrodes 30, 40-46 is 550 mm. The maximum diameter of the cover 100 is 830 mm. Some of these dimensions will be subject to change as the temperature varies. In particular, the height values may be increased by 5 to 10 mm at the working temperature of the electrode module.

The removable electrode module 10 according to the first embodiment of the invention described above may be advantageously used with any electrolysis apparatus having an electrolysis chamber suitable for receiving the module 10 in engagement. A schematic illustration of such an electrolysis apparatus 200 is provided by FIG. 5.

The electrolysis apparatus 200 comprises a housing 210 containing an electrolysis chamber 220 defined within a graphite crucible 230, an upper rim 231 of the graphite crucible 230 defining an opening into the electrolysis chamber 220. An upper surface of the rim 231 is coated with a 15 mm thick section of a resilient graphite material for sealing the rim 231 against an underside of the cover 100 of the removable electrode module 10. The sealing material seated on the upper rim 231 is a braided graphite gland packing material that may be deformed and regain its shape.

The housing 210 furthermore contains furnace heating elements 240 for maintaining the temperature of the graphite crucible 230, a molten salt inlet 250 and a molten salt outlet 260 for allowing a flow of molten salt through the electrolysis chamber 220. A gas vent line 270 is provided towards an upper portion of the electrolysis chamber 220 to allow the escape of gases evolved during any electrolysis reaction taking place within the electrolysis chamber. A DC supply cathode bus bar 280 is coupled to the graphite crucible 230 and enables the entire graphite crucible 230 to directly couple the graphite crucible to a power supply.

The graphite crucible 230 is lined with an alumina liner 290. The alumina liner 290 provides an electrical insulation between side-walls of the graphite crucible 230 and any removable electrode module 10 engaged within the electrolysis chamber 220. Although made from alumina, the liner may be made from any suitable electrically insulating ceramic material that is substantially inert under the processing conditions within the electrolysis chamber 220.

An upper portion of the electrolysis apparatus comprises a gate-valve type closure 300 that enables external access to be provided to the electrolysis chamber 220. The gate-valve closure 300 comprises a gate 310 formed from a thermal barrier material, for example a ceramic material. An actuation device 320 allows the gate 310 to slide back-and-forth to open and close the gate valve 300, thereby allowing access to the electrolysis chamber 220 within the electrolysis apparatus 200.

Figure 1:
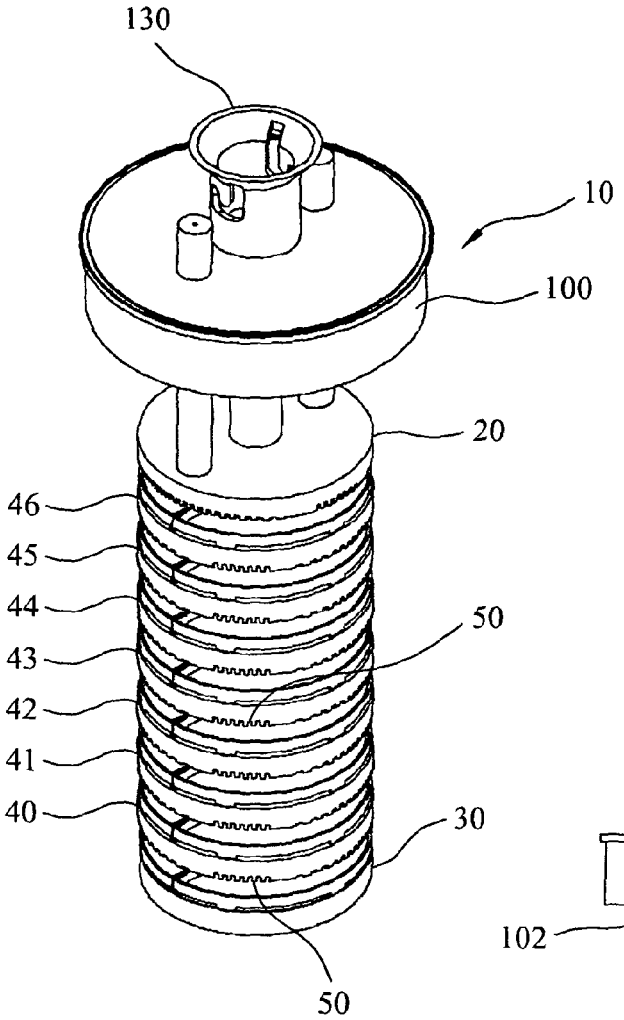
FIG. 1 is a perspective-view of a removable electrode module embodying one or more aspects of the invention.
Figure 2:
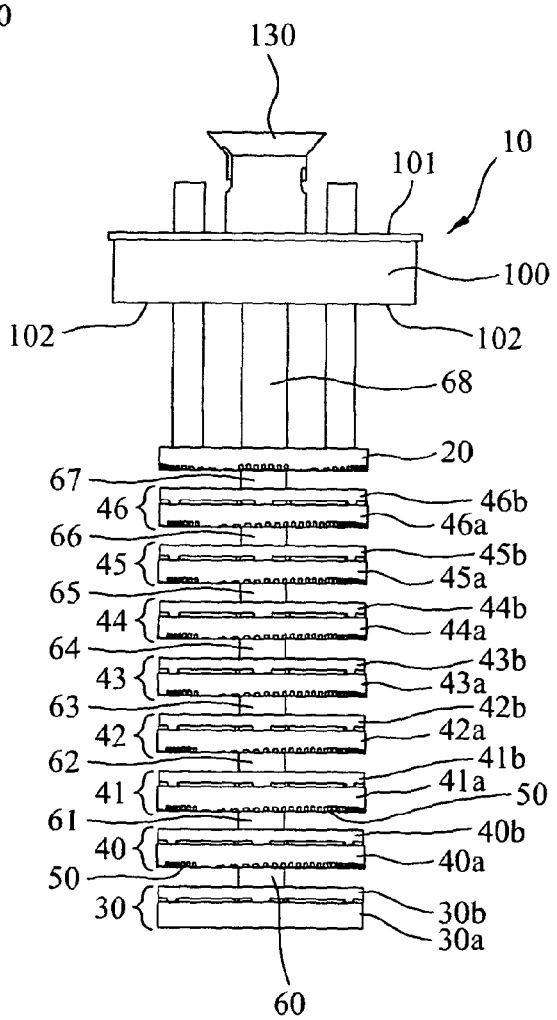
FIG. 2 is a side-view of the removable electrode module of FIG. 1.
Figure 3:
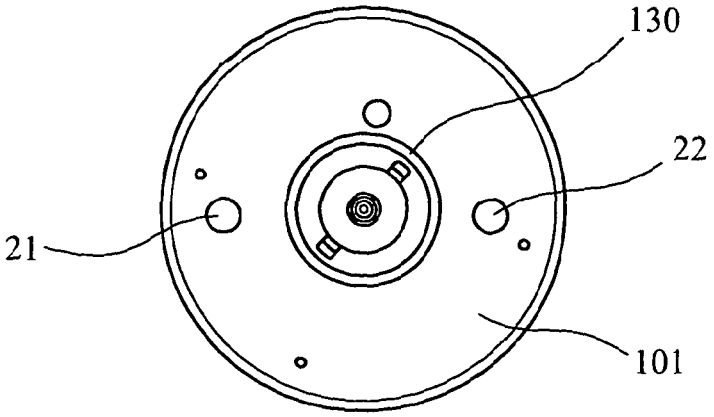
FIG. 3 is a plan-view of the removable electrode module of FIG. 1.
Figure 4:
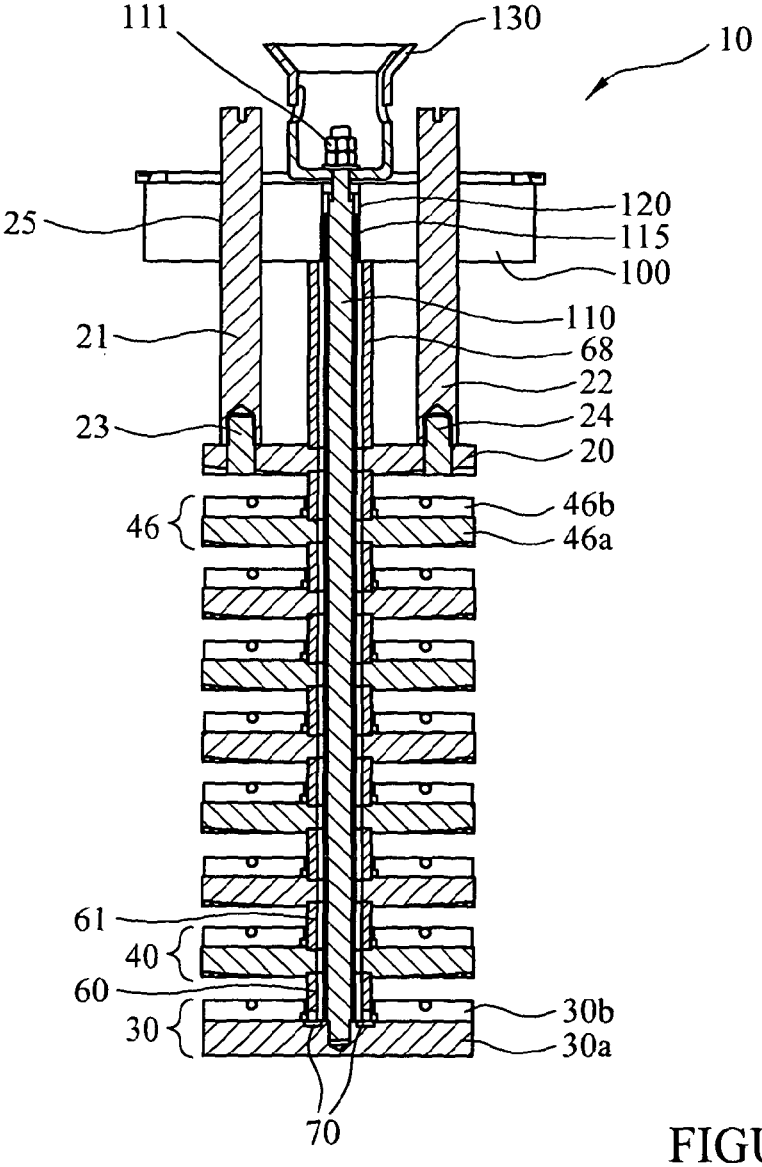
FIG. 4 is a cross-sectional side-view of the removable electrode module of FIG. 1 illustrating the structure of the various electrodes and supporting components of the removable electrode module.
Figure 5:
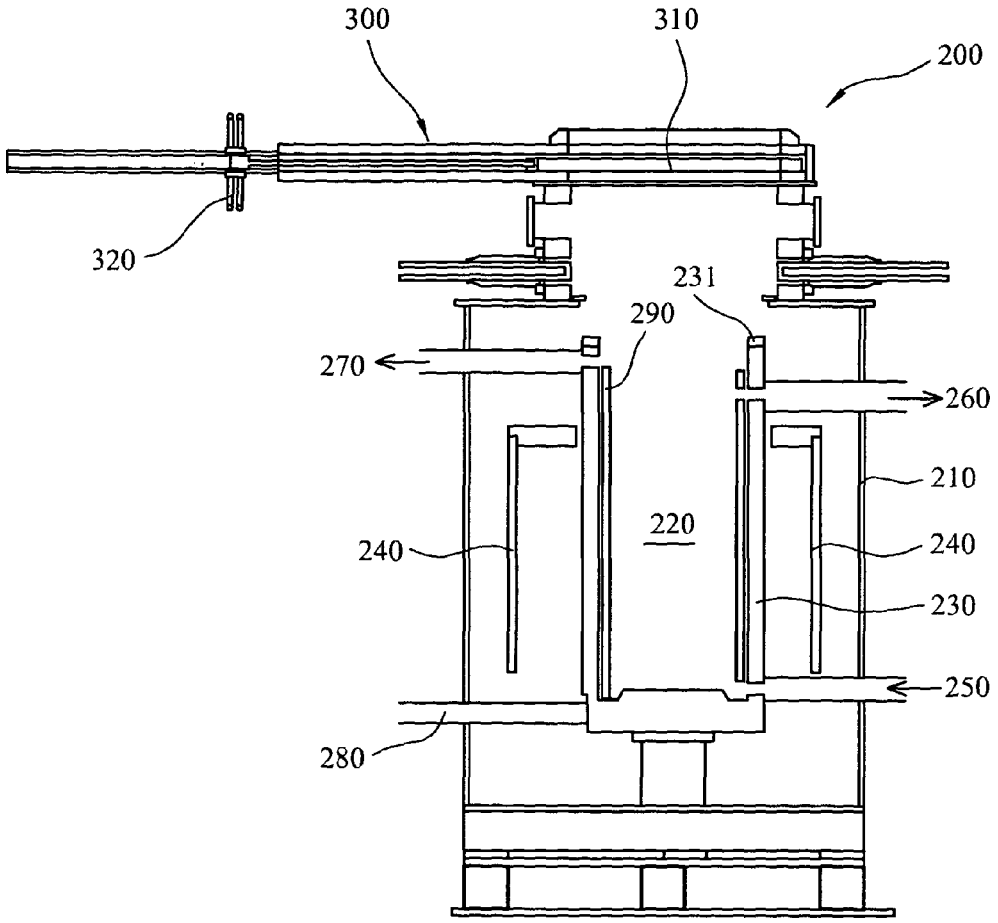
FIG. 5 is a schematic cross-sectional illustration of an electrolysis apparatus having an electrolysis chamber suitable for receiving the removable electrode module embodiment illustrated in FIG. 1.
Figure 6:
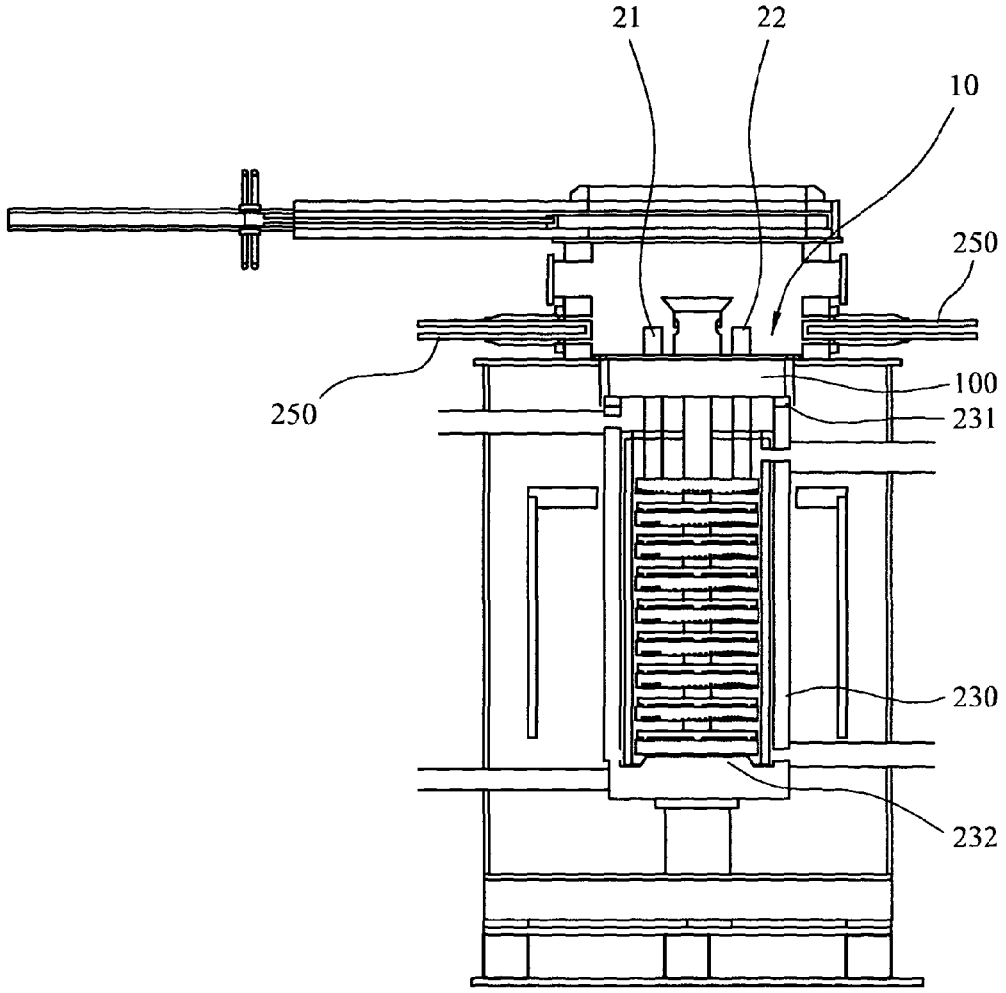
FIG. 6 is a schematic cross-sectional illustration showing the removable electrode module of FIG. 1 in engagement with the electrolysis apparatus illustrated in FIG. 5.

FIG. 6 illustrates a removable electrode module, according to the first embodiment described above in relation to FIGS. 1 to 4, engaged with an electrolysis apparatus of the type illustrated in FIG. 5.

A lower internal surface of the graphite crucible 230 is raised forming a pedestal 232. When engaged with the electrolysis chamber 220, the removable electrode module 10 is seated on this raised pedestal 232 within the graphite crucible 230. Thus, the lower surface of the terminal cathode 30 of the removable electrode module is in physical and electrical contact with an internal surface of the graphite crucible 230.

The bipolar electrodes 40-46 and the anode 20 of the removable electrode module 10 are situated within a portion of the electrolysis chamber that is electrically-insulated from the side-wall of the crucible 230 by the ceramic liner 290. A lower surface 102 of the cover 100 of the removable electrode module 10 makes contact with the upper rim 231 of the graphite crucible 230. As the cover comes into contact with the rim 231 the flexible graphite sealing material seated on the upper rim deforms to enable a seal to be made. It is noted that the graphite sealing material could alternatively or additionally be located on the lower surface 102 of the cover 100.

In use, the temperature within the electrolysis chamber may vary considerably. Thus, the dimensions of some components of the removable electrode module, for example the suspension rod 110, may change by several millimeters. The resilient material seated on the upper rim of the graphite crucible 230 preferably has sufficient resilience and deformability to accommodate any such thermal distortion and maintain a viable seal with the underside 102 of the cover 100.

The anode risers 21, 22 of the removable electrode module extend upwardly through the cover 100. Electrical contact may be made with these risers by actuatable DC anode bus bars 250, which may be actuated to contact the anode risers and thus provide an electrical connection between the anode and the power supply.

In use, the electrolysis chamber 220 is filled with a molten salt and a removable electrode module loaded with a reduceable feedstock is engaged with the electrolysis chamber. The anode bus bars are actuated to contact the anode risers 21, 22 and a potential is applied between the anode 20 (by way of the anode risers and the actuatable anodic bus bars 250) and the terminal cathode 30 (by way of the graphite crucible 230 and the cathodic DC bus bar 280). The potential applied is sufficient to reduce the feedstock. The required potential may vary dependent upon the type of feedstock and the composition of the molten salt.

In many situations, in particular for the reduction of a solid feedstock in a molten salt electrolyte, it may be advantageous to be able to engage a removable electrode module with an electrolysis chamber of an electrolysis apparatus that is at or near to its working temperature. For many molten salt electrolytes this means that the electrolysis chamber contains a molten salt at a temperature of between 500° C. and 1200° C. If a removable electrode module at room temperature was to be inserted into an electrolysis chamber containing a molten salt at a temperature of, for example, 1000° C., then the components of the removable electrode module would be likely to undergo severe and rapid thermal distortion. In particular, the ceramic components of the removable electrode module may undergo severe thermal shock and, thus, fail. As a complication, if the removable electrode module as described above in relation to the first embodiment of a removable electrode module were preheated to a temperature of 1000° C. in air, the graphite components of the removable electrode module would combust.

It may be particularly desirable to be able to remove a removable electrode module from an electrolysis chamber of an electrolysis apparatus immediately after electrolysis has taken place and without waiting for the electrolysis chamber to cool. Care would need to be taken to ensure that oxygen containing atmosphere such as air did not come into contact with the removable electrode module at high temperatures. Failure to safeguard against this could result in the graphite components of the electrode module combusting, reduced metallic product located within the removable electrode module combusting or oxidising and severe thermal deformations and failures occurring due to rapid cooling of the module.

In order to allow the removable electrode module to be engaged with the electrolysis chamber of the electrolysis apparatus at temperature near to working temperature, and in order to allow the removable electrode module to be disengaged from the electrolysis chamber at a temperature close to working temperature, it is desirable that the removable electrode module can be withdrawn into a transfer module before being transferred or transported to the electrolysis apparatus. A transfer module may include heating and/or cooling elements. A transfer module may simply be a shroud within which an inert atmosphere can be maintained that insulates a preheated electrode module prior to loading into the electrolysis chamber or insulates an electrode module recently disengaged from an electrolysis chamber prior to being transported to a separate location for a controlled cooling.

Figure 7:
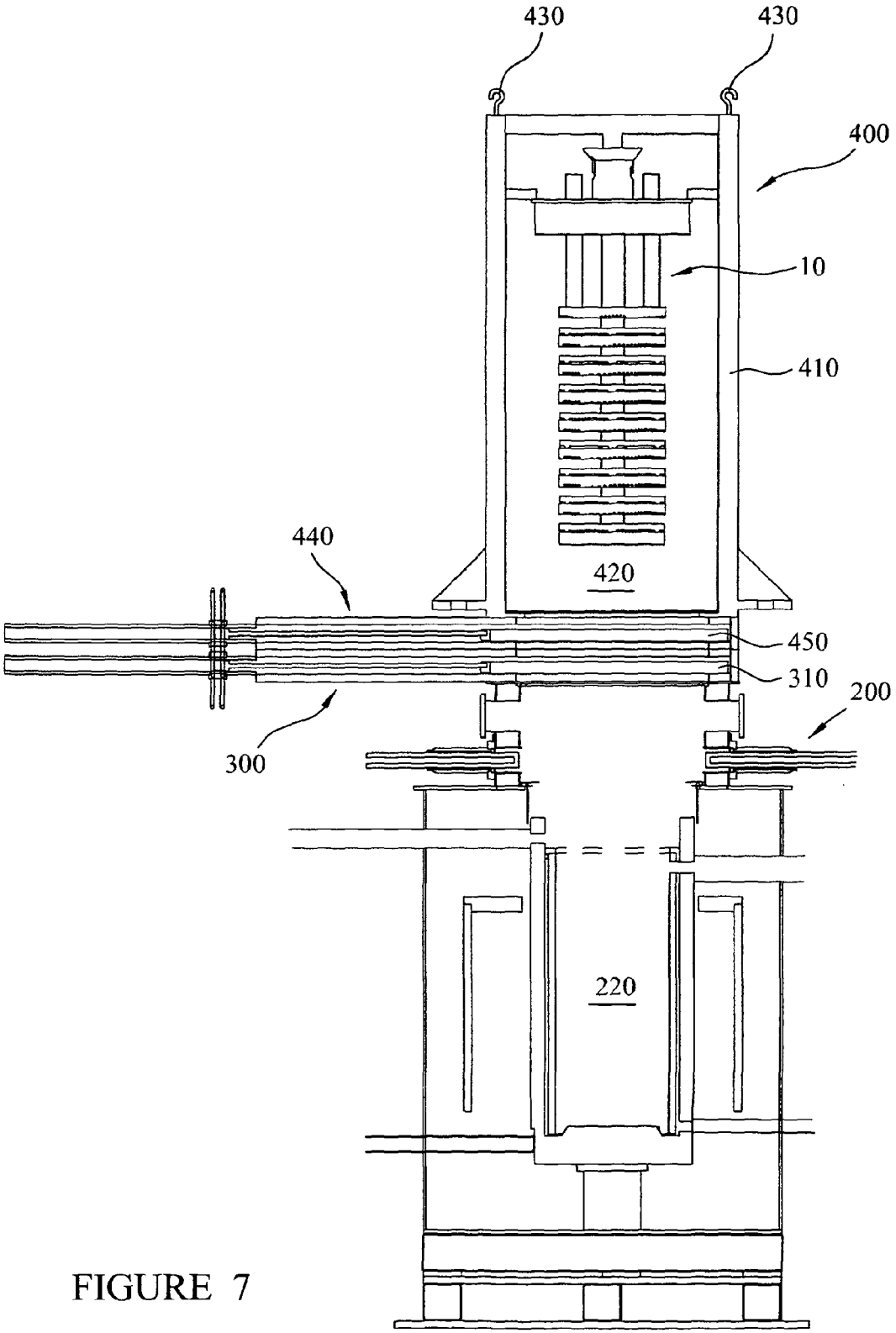
FIG. 7 is a schematic cross-sectional illustration showing the removable electrode module of FIG. 1 housed within a transfer module seated on the electrolysis apparatus of FIG. 5, in preparation for engaging the electrode module with the electrolysis chamber of the electrolysis apparatus.

FIG. 7 illustrates a removable electrode module as described above in relation to FIGS. 1 to 4 located within an embodiment of a removable transfer module 400. The removable transfer module 400 comprises a housing 410 formed from 310-grade stainless steel and lined with a refractory lining. The refractory lining may be a ceramic brick lining or any other suitable material, such as fibreboard, that thermally insulates the interior of the transfer module. The interior of the transfer module comprises a transfer cavity 420 within which a removable electrode module 10 may be located.

A transfer module may comprise a means for coupling to the j-slot connector at the top of the removable transfer module and means for withdrawing the removable transfer module into the transfer chamber 420. For example, the transfer module 400 may comprise a winch for lifting the removable electrode module.

An upper portion of the transfer module 400 comprises means for lifting the transfer module such as a hook or hooks 430. Such lifting means enable the entire transfer module to be lifted and moved to and from an electrolysis apparatus 200.

Figure 8:
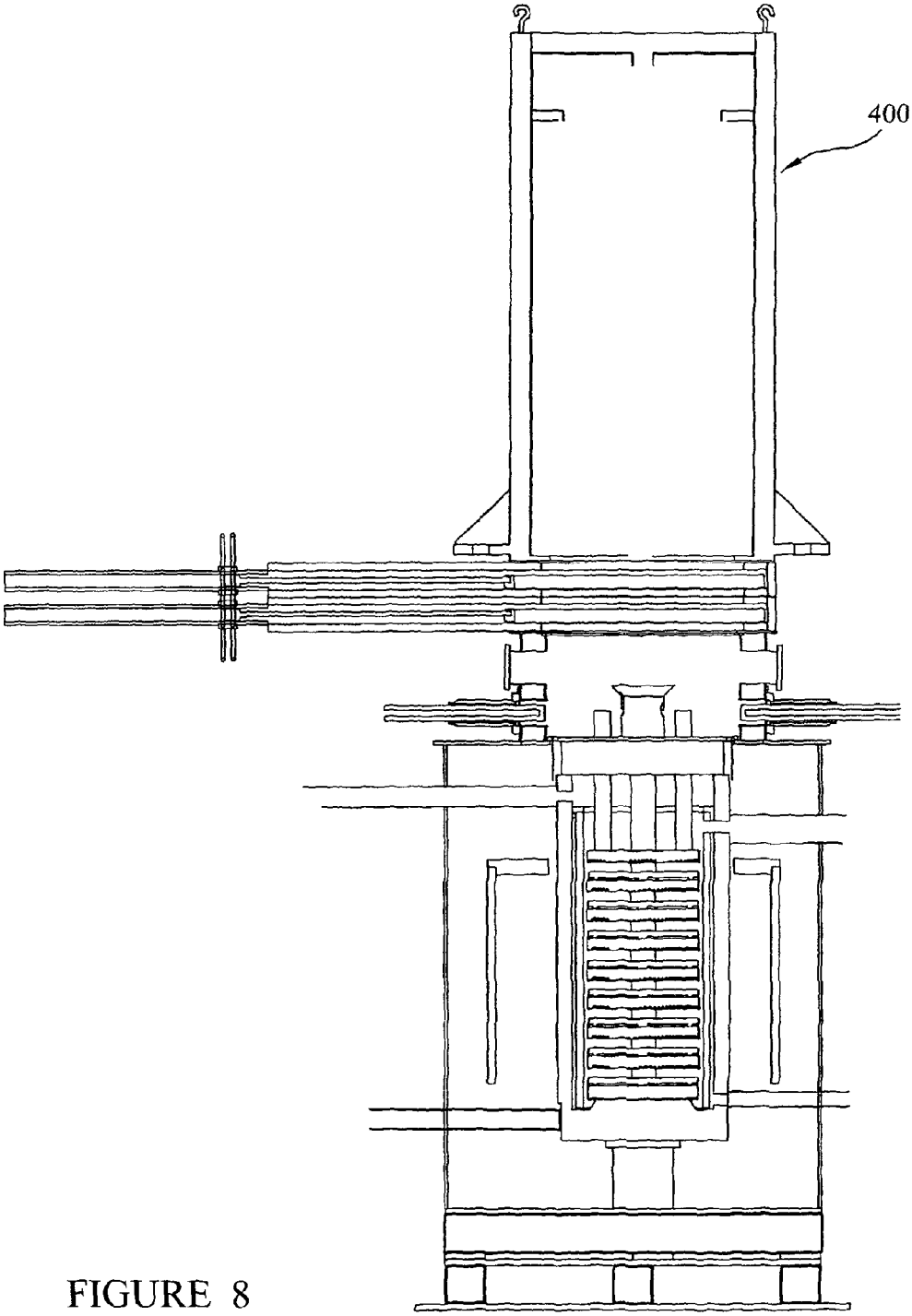
FIG. 8 is a schematic cross-sectional illustration showing the removable electrode module of FIG. 1 after it has been passed from a transfer module and engaged with the electrolysis apparatus of FIG. 5.

A lower portion of the transfer module 400 is closed by a gate-valve 440. This gate-valve comprises a thermally resistant gate 450 that is actuable to open and close an opening into the transfer module chamber 420. The transfer module, including the gate-valve, may conveniently be seated atop the gate-valve of an electrolysis apparatus 200, as described above in relation to FIG. 5. By opening the gate-valves associated with both the transfer module 440 and the electrolysis apparatus 200, access can be provided to the opening of the electrolysis chamber 220. The removable electrode module 10 can then be lowered from the transfer chamber 420, through the openings of both the gate-valve associated with the transfer module and the gate-valve associated with the electrolysis apparatus, to enable the electrode module to be located within the electrolysis chamber 220. The respective gate-valves can then be closed, as illustrated in FIG. 8, and the transfer module 400 may then be removed.

The first embodiment of a removable transfer module, as described above and illustrated in FIGS. 1 to 4, comprised eight effective working electrodes on which solid feedstock could be reduced (i.e. the upper portion of the terminal cathode 30 and the upper portions of each of the bipolar electrodes 40-46). For some reactions it may be desired to reduce a lower volume of a solid feedstock. For such purposes, it may be desirable that a removable electrode module has a lower area of cathodic-electrode surface. A second embodiment of a removable electrode module according to one or more aspects of the invention is illustrated by FIG. 12.

Figure 12:
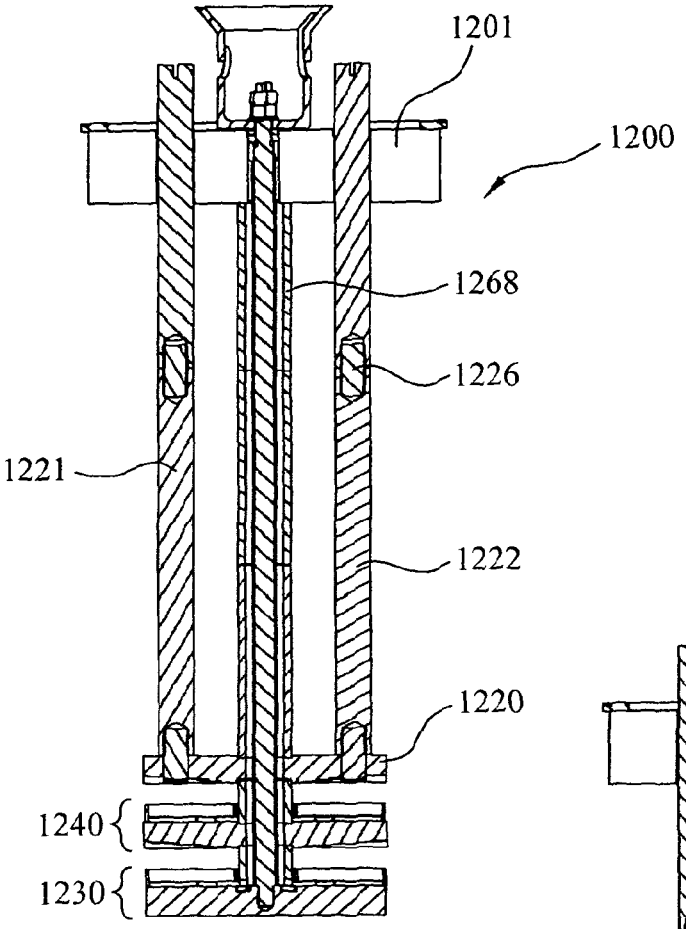
FIG. 12 is a cross-sectional illustration of a second embodiment of a removable electrode module according to one or more aspects of the invention.

The overall dimensions of the removable electrode module as illustrated in FIG. 12 are the same as the removable electrode module illustrated in FIGS. 1 to 4 and, thus, this second embodiment of a removable electrode module may be used in conjunction with the same electrolysis apparatus as the first embodiment. However, the removable electrode module of the second embodiment of the invention 1200 comprises a terminal cathode 1230 and a terminal anode 1220, with only a single bipolar electrode 1240 disposed between the terminal anode 1220 and the terminal cathode 1230. The terminal anode terminal cathode and the bipolar electrode are identical in construction to the equivalent structures described above in relation to the first embodiment of the invention. As there are fewer bipolar electrodes disposed between the terminal anode 1220 and the terminal cathode 1230, the graphite electrode risers 1221 and 1222 are substantially longer than those described above in relation to the first aspect of the invention. If needed, several sections of graphite risers may be joined by internal threaded studs 1226. The cover 1201 is supported directly above the upper surface of the anode 1220 by means of a plurality of electrically insulating ceramic spacers 1268.

Apart from these specific adaptations required to ensure the external dimensions of this removable electrode module are the same as the dimensions of the module of the first embodiment of the invention, all other elements of the removable electrode module according to the second embodiment of the invention are the same as described above.

Figure 13:
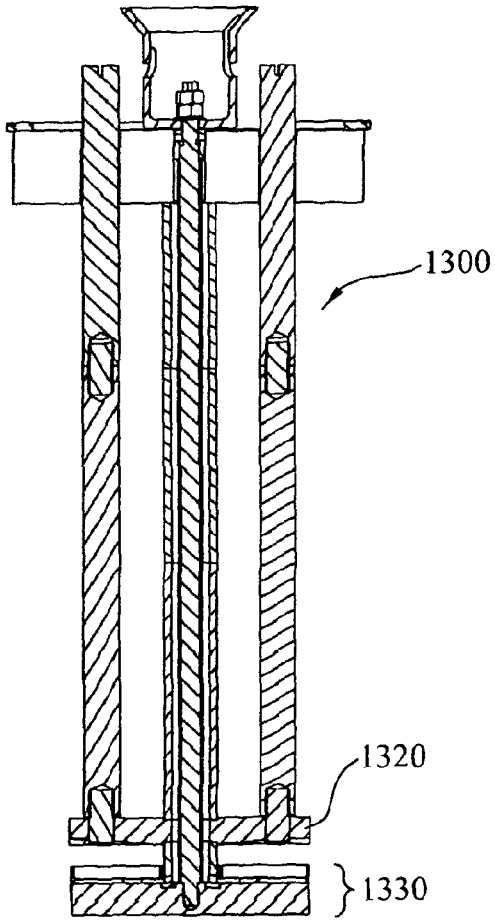
FIG. 13 is a cross-sectional illustration of a third embodiment of a removable electrode module according to one or more aspects of the invention.

According to certain aspects of the invention, it is not essential that a removable electrode module comprises a bipolar electrode. FIG. 13 illustrates a third specific embodiment of a removable electrode module according to one or more aspects of the invention. This third embodiment comprises a terminal anode 1320 and a terminal cathode 1330, but does not comprise a bipolar electrode. The terminal cathode 1330 and the terminal anode 1320 are constructed in the same way as the terminal anode 20 and the terminal cathode 30 described above in relation to the first embodiment of the invention. The external dimensions of the removable electrode module 1300 of the third embodiment are the same as the dimensions of the first and second embodiments of a removable electrode module. All other details of the third embodiment of a removable electrode module as illustrated in FIG. 13 are as described above in relation to the first embodiment or the second embodiment of the removable electrode module.

Figure 14:
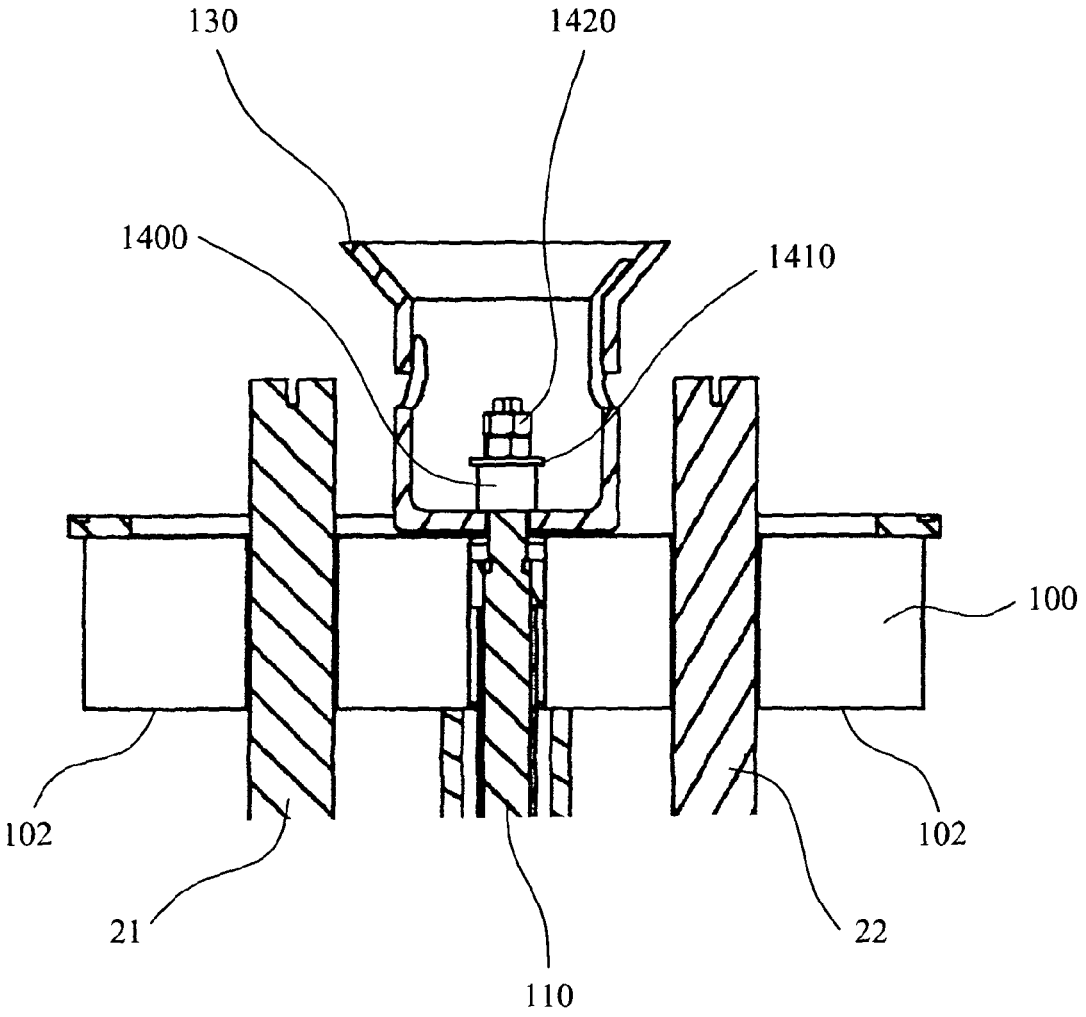
FIG. 14 is a schematic cross-sectional illustration of an alternative method of coupling a removable electrode module according to an embodiment of the invention to a lifting means.

In the embodiments described above a suspension rod 110 is coupled to a j-slot connector 130 by clamping an end of the rod 110 to the connector 130 by means of washers and bolts 111. Any tolerance needed to form a seal between an underside of the cover 100 and a rim 231 of a crucible 230 forming an opening into an electrolysis chamber 220 is achieved by the use of a resilient sealing material on the rim. FIG. 14 illustrates an alternative coupling that may be used in an embodiment of a removable electrode module. For ease of reference, components that are identical to those present in the first embodiment described above have been given the same reference numerals.

In the alternative embodiment illustrated in FIG. 14 a suspension rod 110 of the electrode module is coupled to a j-slot connector 130 by means of a flange 1410 which transfers load through a set of Bellville springs 1400 and on to the j-slot connector. The flange 1410 is secured against the spring 1400 by means of nuts 1420.

When the module is lifted, the weight of the module is transferred through the suspension rod 110 and compresses the spring 1400. The spring urges upwards against a lower surface of the flange 1410. The spring 1400 may be any suitable spring means. For example, the spring may comprise a helical spring.

Coupling an electrode module to a lifting means such as a j-slot connector with a resilient spring disposed between may provide advantages in use. For example, as the electrode module is lowered into an electrolysis chamber as described above, contact is made between a rim surrounding the opening of the chamber and a lower surface 102 of the cover 100 in order to form a seal. In the embodiments described above, the base plate 30*a* of the module must be seated in physical contact with the internal wall of the crucible in order to provide a cathodic connection. The use of a resilient means such as a Belleville spring 1400 disposed between the lifting means and the suspension rod may allow additional travel of the electrode module after a seal has been formed by the cover 100. Furthermore, such a resilient means may advantageously accommodate dimensional changes in the suspension rod caused by thermal fluctuations.

An embodiment of a removable electrode module that includes a resilient means disposed between a suspension rod or rods supporting the electrodes and a lifting means may be employed as an alternative to using a resilient sealing material surrounding the opening of an electrolysis chamber or in addition to it.

We claim:

1. A removable electrode module for engagement with an electrolysis chamber and reduction of a solid feedstock, the removable electrode module comprising, a first electrode, in which the solid feedstock is retainable in contact with a first surface of the first electrode such that the solid feedstock can be reduced by electrolysis, a second electrode, and a suspension structure comprising a suspension rod coupled to the first electrode, in which the second electrode is suspended by, or supported by, the suspension structure and in which the suspension structure comprises at least one electrically-insulating spacer element for retaining the second electrode in spatial separation from the first electrode, the removable electrode module further comprising one or more bipolar electrode having a composite structure, the one or more bipolar electrode having a first portion or cathodic portion made of a metallic material, and a second portion or anodic portion made of a material selected from the list consisting of an inert anode material for the evolution of oxygen, a dimensionally-stabilised anode material and a carbon material, in which the first portion and/or second portion of the one or more bipolar electrode are formed from a porous or perforated or foraminous material, such that molten salt can flow through the first and/or second portion of the bipolar electrode.

2. The electrode module according to claim 1, in which the first electrode is a terminal cathode and the second electrode is a terminal anode, the terminal cathode and the terminal anode being couplable to a power supply to enable a potential to be applied between the terminal cathode and the terminal anode.

3. The electrode module according to claim 1, wherein the one or more bipolar electrode is supported in spatial separation between the first electrode and the second electrode by the at least one electrically-insulating spacer elements.

4. The electrode module according to claim 3, in which a first surface of the one or more bipolar electrode becomes cathodic when a potential is applied between the first electrode and the second electrode, and in which a solid feedstock is retainable in contact with a first surface of the bipolar electrode such that the solid feedstock can be reduced by electrolysis.

5. The electrode module according to claim 1, in which the suspension rod passes through the second electrode.

6. The electrode module according to claim 1, in which the suspension structure comprises more than one suspension rod, each suspension rod being coupled to the first electrode.

7. The electrode module according to claim 1, further comprising a cover for closing an opening of the electrolysis chamber when the module is in engagement with the electrolysis chamber.

8. The electrode module according to claim 7, in which a first surface of the cover interacts with a surface surrounding the opening of the electrolysis chamber to seal the opening of the electrolysis chamber.

9. The electrode module according to claim 7, in which the suspension rod passes through a hole defined through the cover such that a portion of the suspension rod is external to the electrolysis chamber when the module is in engagement with the electrolysis chamber.

10. The electrode module according to claim 7, in which the cover comprises a thermally-insulating material or a plurality of thermally-insulating materials and provides a thermal barrier.

11. The electrode module according to claim 7, in which a first surface of the cover interacts with a surface surrounding the opening of the electrolysis chamber to support at least part of the weight of the electrode module.

12. The electrode module according to claim 7, in which an electrical connection for the second electrode passes through a hole defined through the cover.

13. The electrode module according to claim 1, in which the electrodes include a terminal cathode and a terminal anode, and wherein the one or more bipolar electrode is disposed between the terminal cathode and the terminal anode.

14. The electrode module according to claim 1, for use in the electro-deoxidation of a solid feedstock in a molten salt electrolyte in which the solid feedstock comprises a metal oxide.

15. The electrode module according to claim 14, wherein the metal oxide is a metal compound or a metal oxide, or a mixture of metal compounds or metal oxides.

16. The electrode module according to claim 15, wherein the metal oxide is a titanium oxide or a tantalum oxide.

17. The electrode module according to claim 1, in which the suspension rod is formed from a metallic alloy and at least a portion of the suspension rod is clad in an electrically-insulating material.

18. The electrode module according to claim 1, wherein the at least one electrically-insulating spacer element is formed from a ceramic material.

19. The electrode module according to claim 1 in which the electrodes include a cathode, an electrical connection being made between the cathode and a power supply by physical contact between the cathode and an electrical conductor within the electrolysis chamber.

20. The electrode module according to claim 1, that is suspendable from a lifting element at an upper end of the module, seatable on the first electrode at a lower end of the module, and/or suspendable from a cover.

21. The electrode module according to claim 20, suspendable from a lifting element at an upper end of the module, when being lowered into or lifted out of the electrolysis chamber.

22. The electrode module according to claim 20, seatable on the first electrode at a lower end of the module, when in engagement with the electrolysis chamber.

23. The electrode module according to claim 20, suspendable from the cover when in engagement with the electrolysis chamber.

24. The electrode module according to claim 1, comprising a coupling means for coupling the module to a lifting mechanism to raise and lower the module.

25. The electrode module according to claim 24, in which the coupling means comprises a j-slot connector situated at an upper end of the module, the entire module being capable of being suspended from the j-slot connector.

26. The electrode module according to claim 1, in which the electrodes include an anode, and having electrical connection between the anode and a power supply at more than one point on the anode.

27. The electrode module according to claim 1, in which at least a portion of at least one of the electrodes is removable from the module for loading with a feedstock.

28. The electrode module according to claim 1, comprising between 1 and 20 of the at least one bipolar electrode.

29. The electrode module according to claim 1, wherein the porous or perforated or foraminous material is a mesh.

* * * * *